US007866643B2

(12) United States Patent
Nakamichi et al.

(10) Patent No.: US 7,866,643 B2
(45) Date of Patent: Jan. 11, 2011

(54) IMAGE FORMING SYSTEM AND PROGRAM THEREOF

(75) Inventors: Motoki Nakamichi, Hachioji (JP); Tetsuo Hirata, Hachioji (JP); Norishige Kato, Hachioji (JP); Takehiro Ogushi, Hachioji (JP); Yasushi Saitsu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 655 days.

(21) Appl. No.: 11/828,845

(22) Filed: Jul. 26, 2007

(65) Prior Publication Data

US 2008/0038092 A1 Feb. 14, 2008

(30) Foreign Application Priority Data

Aug. 9, 2006 (JP) ..... 2006-216761

(51) Int. Cl.
*B65H 37/04* (2006.01)

(52) U.S. Cl. ..... 270/21.1; 270/20.1; 270/32; 270/37; 270/45; 270/58.07; 270/58.08; 270/58.09

(58) Field of Classification Search ..... 270/32, 270/37, 20.1, 21.1, 45, 58.07, 58.08, 58.09; 412/4, 14, 16, 19, 33
See application file for complete search history.

(56) References Cited

U.S. PATENT DOCUMENTS 7,524,155 B2 * 4/2009 Hata et al. ..... 412/19
7,543,805 B2 * 6/2009 Yoshie et al. ..... 270/58.08
7,584,949 B2 * 9/2009 Kaneko et al. ..... 270/58.12
2007/0045928 A1 * 3/2007 Yoshie et al. ..... 270/58.08
2007/0170631 A1 * 7/2007 Kato et al. ..... 270/37
2008/0237962 A1 * 10/2008 Kubota et al. ..... 270/21.1
2009/0245975 A1 * 10/2009 Hattori ..... 412/37
2009/0311077 A1 * 12/2009 Kato ..... 412/13
2010/0003108 A1 * 1/2010 Motoyoshi ..... 412/37

FOREIGN PATENT DOCUMENTS

JP 2004-209870 7/2004

* cited by examiner

*Primary Examiner*—Leslie A Nicholson, III
(74) *Attorney, Agent, or Firm*—Finnegan, Henderson, Farabow, Garrett & Dunner, L.L.P.

(57) ABSTRACT

An image forming system including an image forming apparatus and a book binding apparatus, the image forming system includes: a first detection section which detects maximum and minimum book-body sheet length in the bundle of the book-body sheets; a second detection section which detects a thickness of the bundle of the book-body sheets; a third detection section which detects a cover sheet length; a selection section to select whether the cover sheet length is determined based on the maximum book-body sheet length or on the minimum book-body sheet length; a calculation section which calculates a cutting amount of the cover sheet according to the selection; a trimming section which cuts the cover sheet based on the calculated cutting amount; and a book binding section which encases the bundle of sheets of the book-body with the U-shaped cover sheet.

5 Claims, 5 Drawing Sheets

FIG. 3 (b) WHEN COVER SHEET FOR MAX. BOOK-BODY LENGTH IS SELECTED

FIG. 3 (c) WHEN COVER SHEET FOR MIN. BOOK-BODY LENGTH IS SELECTED

IMAGE FORMING SYSTEM AND PROGRAM THEREOF

CROSS REFERENCE TO RELATED APPLICATION

The present application is based on Japanese Patent Application No. 2006-216761 filed with Japan Patent Office on Aug. 9, 2006, the entire content of which is hereby incorporated by reference.

BACKGROUND OF THE INVENTION

1. Field of Technology

This invention relates to an image forming system and a program thereof.

2. Description of Related Art

The image forming system configured by an image forming apparatus and a book binding apparatus has been known. For example, Japanese Patent Application Publication Open to Public Inspection No. 2004-209870 has disclosed an image forming system for manufacturing booklets, namely for conducting a case binding, by encasing a bundle of book-body sheets (it may be simply called a book-body) into a U-shaped cover sheet, which is going to be contents of a booklet, and pasting the back section of the bundle of sheets of the book-body onto a cover sheet.

In Japanese Patent Application Publication Open to Public Inspection No. 2004-209870, only book-body sheets having the same length are supposed to be used, when conducting a case binding. The cover sheet is cut so that the length of a cover sheet becomes (a length of book-body sheet×2+thickness of book-body). Hereinafter, a "the length" direction denotes a direction, which is along the direction of encasing the book-body sheets into the cover sheet. (Hereinafter, "the length" denotes a length in the direction defined above unless otherwise specified).

However, when conducting a case binding by encasing the book-body including a plurality of book-body sheets having different lengths into a cover sheet, for example, there may be a possible situation where conducting a book binding by encasing other book-body sheets, into which a tub paper sheet having a longer length than the length of the other book-body sheets, into a cover sheet.

An object of the present invention is to provide an image forming system and a program thereof, which are capable of book binding in response to the needs of users even when conducting book binding by encasing a book-body including various kinds book-body sheets having different lengths into a cover sheet to solve the problems described above.

SUMMARY

In accordance with one aspect of the present invention, An image forming system including an image forming apparatus which forms an image on a book-body sheet and a book binding apparatus which conducts book binding by encasing a bundle of book-body sheets with a U-shaped cover sheet, the image forming system comprising: a first detection section which detects a maximum book-body sheet length and a minimum book-body sheet length among length of sheets in the bundle of the book-body sheets; a second detection section which detects a thickness of the bundle of the book-body sheets; a third detection section which detects a cover sheet length; a selection section to select whether the cover sheet length is determined based on the maximum book-body sheet length or on the minimum book-body sheet length; a calculation section which calculates a cutting amount of the cover sheet based on the maximum book-body sheet length detected by the first detection section, the thickness of the bundle of the book-body sheets detected by the second detection section and the cover sheet length detected by the third detection section when selected is that the cover sheet length is determined based on the maximum book-body sheet length by the selection section, and which calculates a cutting amount of the cover sheet based on the minimum book-body sheet length detected by the first detection section, the thickness of the bundle of the book-body sheets detected by the second detection section and the cover sheet length detected by the third detection section when selected is that the cover sheet length is determined based on the minimum book-body sheet length by the selection section; a trimming section which cuts the cover sheet based on the cutting amount of the cover sheet calculated by the calculation section; and a book binding section which conducts a book binding by encasing the bundle of sheets of the book-body with the U-shaped cover sheet.

In accordance with anther aspect of the present invention, a computer program product for causing a computer to execute procedures including: a first input step for inputting a maximum book-body sheet length and a minimum book-body sheet length among length of sheets in the bundle of the book-body sheets; a second input step for inputting a thickness of a bundle of the book-body sheets; a third input step for inputting a cover sheet length; a selection information input step for inputting selection information whether the cover sheet length is determined based on the maximum book-body length or the on the minimum book-body sheet length; a calculation step for calculating a cutting amount of the cover sheet based on the length of the maximum book-body length inputted in the first input step, the thickness of the bundle of the book-body sheets inputted in the second input step and the cover sheet length inputted in the third input step in cases where in the selection information input step inputted has been the selection information that the cover sheet length is determined based on the maximum book-body sheet length, and for calculating a cutting amount of the cover sheet based on the minimum book-body sheet length inputted in the first input step, the thickness of the bundle of the book-body sheets inputted in the second input step and the cover sheet length inputted in the third inputted step in cases where in the selection information input step inputted has been the selection information that the cover sheet length is determined based on the minimum book-body sheet length.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT (System Configuration)

Figure 1:
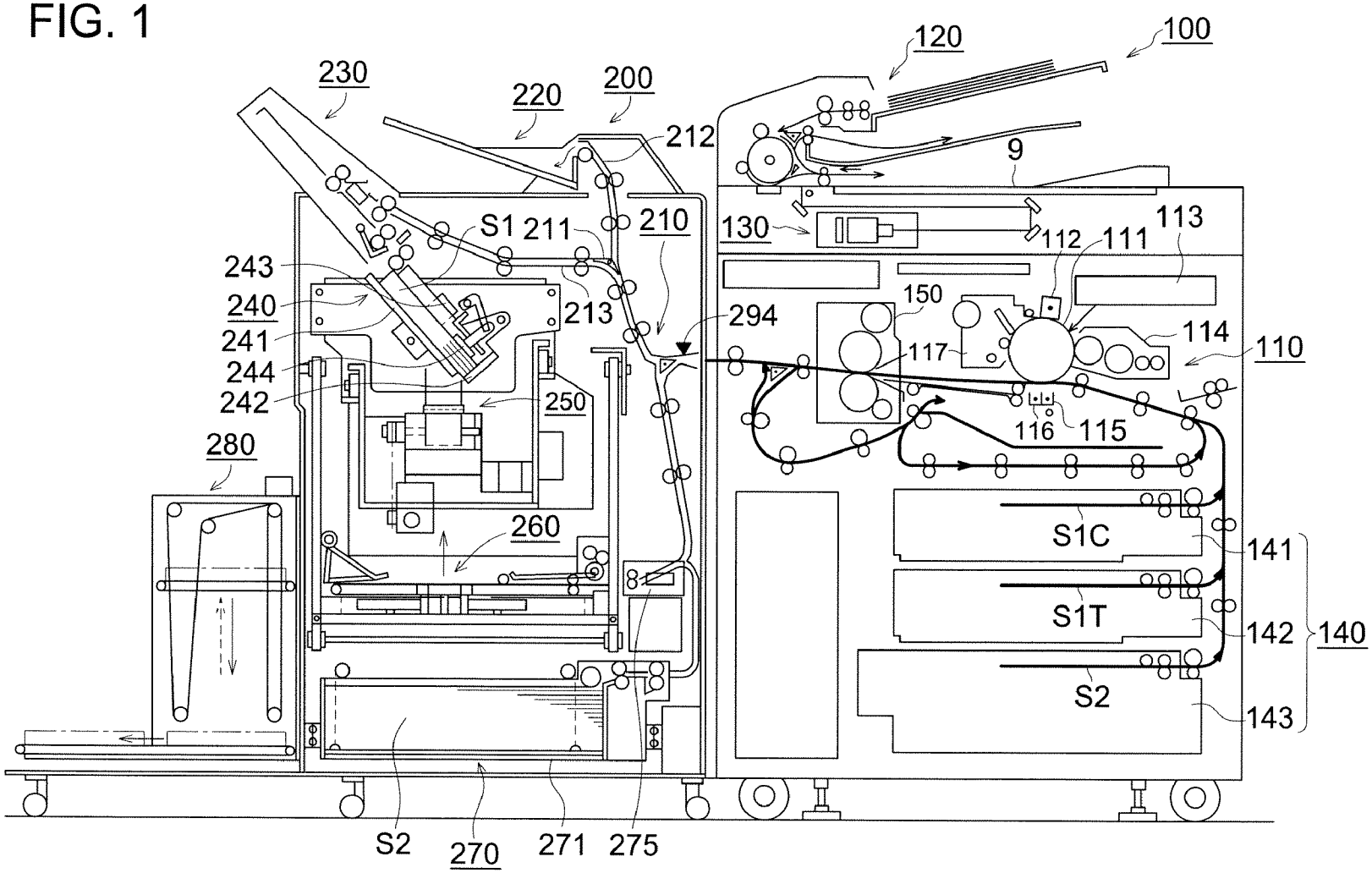
FIG. 1 illustrates a system configuration of an image forming system related to an embodiment of the present invention.

FIG. 1 illustrates a system configuration of an image forming system related to an embodiment of the present invention. The image forming system comprises an image forming apparatus 100 and a book binding apparatus 200.

<Image Forming Apparatus>

The image forming apparatus 100 is an apparatus for forming an image onto a sheet by using an electro-photographic system. The image forming apparatus 100 comprises an image forming section 110, an original document conveyance section 120, an image reading section 130 and a sheet feeding section 140.

The original document conveyance section 120 conveys a placed original document toward the image reading section 130.

The image reading section 130 reads out the image from the original document conveyed by the original document conveyance section 120 and outputs the read image data.

The image forming section 110 has a structure, in which a charging apparatus 112, an exposing apparatus 113, a developing apparatus 114, a transfer apparatus 115, a separation apparatus 116 and a cleaning apparatus 117 are disposed around a photoreceptor 111, where respective processes of charging, exposure, development, transfer and cleaning are executed. The exposure is conducted based on the image data outputted from the image reading section 130 and a toner image is formed onto a sheet based on the image data.

A sheet feeding section 140 includes a plurality of sheet feeding cassettes 141, 142 and 143 for feeing the designated sheet toward the image forming section 110. For example, as shown in FIG. 1, sheet feeding cassettes 141 and 142 respectively store normal size sheets S1C, which becomes a content of a booklet as book-body sheets S1 and tub sheets S1T having longer length than that of the normal size sheets S1C. The sheet feeding cassette 143 stores a cover sheet S2.

A fixing section 150 gives heat and pressure onto the sheet, on which a toner image has been formed, conveyed from the image forming section 110 to fix the toner image on the sheet.

<Book Binding Apparatus>

A book binding apparatus 200 is to bind a plurality of book-body sheets S1 conveyed from the image forming apparatus 100 to make a book-body, to paste a cover sheet S2 onto the back of the book-body and to encase the book-body into the cover sheet S2 formed in a U-shape to make a booklet.

The book binding apparatus 200 comprises a conveyance section 210, a sub-tray 220, a sub-compiling section 230, a clamping section 240, a gluing section 250, a square back forming section 260, a cover sheet feeding section 270, a trimming section 275 and a booklet storage section 280.

In the case when case binding is not conducted, sheets are ejected into the sub-tray 220. The sheets conveyed through the conveyance section 210 are ejected into the sub-tray 220 by switching the gate 211 so that the sheets move toward an ejection path 212.

When case binding is conducted, the book-body sheets S1 is sequentially conveyed into the sub-compiling section 230. The sheets conveyed through the conveyance section 210 are conveyed to the sub-compiling section 230 by switching the gate 211 so that the sheets move toward an ejection path 213. When the clamping section 240 is under the state where a preceding bundle of book-body sheets S1 is in the book binding process and the following book-body sheets S1 cannot be conveyed to the clamping section 240, the following book-body sheets S1 are to be temporarily collected. When no preceding bundle of book-body sheets S1 exists in the claming section 240, the book-body sheets S1 conveyed to the sub-compiling section 230 are to be conveyed to the clamping section 240 as they have been after being switched back at the sub-compiling section 230.

The clamping section 240 is arranged to collect and clamp the bundle of book-body sheets S1, which is a unit of a booklet, conveyed through the sub-compiling section 230. The bundle of the book-body sheets S1 collected in the clamping section 240 becomes a book-body of a booklet. The clamping section 240 comprises a support board 241 for supporting the lower surface of the collected book-body sheets S1, a regulation board 242 for regulating the front edge, an adjustment board 243 for adjusting the side edge and a clamp 244 for pressing and fixing the top surface of the book-body. The clamping section 240 swings so that the back of the book-body perpendicularly faces downward after clamping the book-body.

A gluing section 250 is to paste glue on the back of the book-body clamped by the clamping section 240.

The sheet feeding section 270 includes a sheet feeding cassette 271 for storing a cover sheet S2 and conveys the cover sheet S2 toward the cutting section 275.

The cutting section 275 cuts the cover sheet S2, which has been conveyed from the sheet feeding cassette 271 or a sheet feeding cassette 143 of the image forming apparatus 100, into a predetermined length. When forming an image on the cover sheet S2, the cover sheet S2 is conveyed from the sheet feeding cassette 143 of the image forming apparatus 100.

The square forming section 260 rises after the cover sheet S2 conveyed from the trimming section 275, which has been cut, stops at a predetermined position. Based on this operation, the cover sheet S2 placed on the square back forming section 260 is contacted and glued with the book-body, to the back of which glue has been coated, which has been clamped on the claming section 240. At that time, the cover sheet S2 is bent along the shape of the book-body and a square back is formed. Based on this operation, the cover sheet S2 encases the book-body therein and a booklet is formed. After that, the square back forming section 260 falls down. Then the square back forming section 260 ejects the booklet shaped into a square back, which has been glued, to a booklet storing section 280.

(Control Structure)

Figure 2:
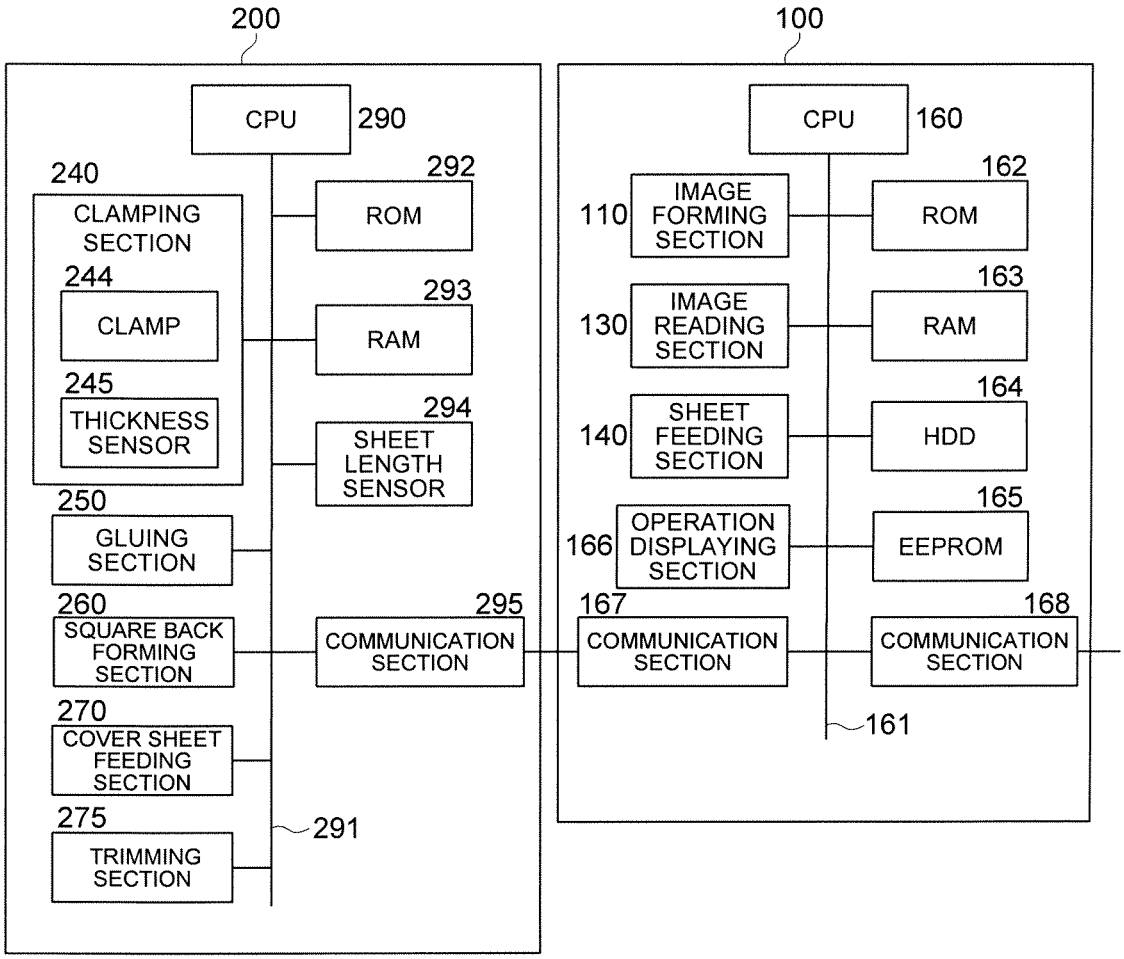
FIG. 2 illustrates a control configuration of an image forming system related to an embodiment of the present invention.

FIG. 2 illustrates a control configuration of an image forming system related to an embodiment of the present invention. The portion, which does not relate to this invention, has been omitted here.

<Image Forming Apparatus>

The image forming apparatus 100 comprises a CPU 160, which is a control section for executing various controls of the image forming apparatus 100 based on a program, bus 161, a ROM 162, a RAM 163, a HDD 164, a EEPROM 165, an image forming section 110, an image reading section 130, a sheet feeding section 140, an operation display section 166, a communication sections 167 and 168, which are connected each other centering on the CPU 160.

The ROM 162 stores various programs and data. The CPU 160 executes the control of the image forming apparatus 100 by using the programs and the data.

The CPU 160 utilizes the RAM 163 as a work area for temporarily memorizing the programs and the data necessary when the CPU 160 executes the control.

The HDD 164 memorizes the image data inputted from the image reading section 130 and the image data inputted from external apparatuses, such as a personal computer, through the communication section 168.

The EEPROM 165 memorizes various sizes of sheets stored in respective sheet feeding cassettes of the sheet feeding section 140 and the cover sheet feeding section 270.

The image forming section 110 forms an image on a sheet based on the image data inputted from the image reading section 130 and the image data inputted from the external apparatuses, such as the personal computer through the communication section 168.

The operation display section 166 configured by a touch panel displays various operation screens and is used to inputs various instructions.

The communication section 167 is connected with the book binding apparatus 200 and is arranged to transmit and receive various data between the book binding apparatus 200 and the image forming apparatus 100.

The communication section 168 is connected with outside network to receive input image data from personal computers.

With respect to the image reading section 130 and the sheet feeding section 140, since the description of those sections has been completed previously, the explanation will be omitted here.

<Book Binding Apparatus>

The book binding apparatus 200 includes a CPU 290 for executing various controls of the book binding apparatus 200 according to the program. A ROM 292, a RAM 293, a sheet length sensor 294, a clamping section 240, a gluing section 250, a square back forming section 260, a cover sheet feeding section 270, a trimming section 275 and a communication section 295 are mutually connected on the bus 291 centering the CPU 294.

The ROM 292 memorizes various programs and data. The CPU 290 utilizes these programs and the data to execute control of the book binding apparatus 200.

The CPU 290 utilizes the RAM 293 as a work area for temporarily memorizing the programs and the data necessary when the CPU 290 executes the control.

The sheet length sensor 294 is provided in the conveyance section 210 (refer to FIG. 1), to detect the front edge and the rear edge of the sheet in the conveying state. The length of the sheet, which is in the conveyance state, can be calculated by utilizing the sheet length sensor 294.

The clamping section 240, as an object to be controlled, includes the thickness sensor 245 other than the clamp 244 described above. The thickness sensor 245 detects the thickness of the book-body, which has been set in the clamp 240. For example, the thickness of the book-body is obtained by detecting the position of the clam 244 when claming the book-body. When the book-body is thick, the front edge of the clamp 244 is positioned far from the support board 241, and when the book-body is thin, the front edge of the clam 244 is positioned close to the support board 241. Other than this, the thickness of the book-body can be detected by obtaining the shift amount of the clamp 244 from the home position when claming the book-body.

Since the gluing section 250, the square back forming section 260, the cover sheet feeding section 270 and the trimming section 275 have been described above, the description will be omitted here.

The communication section 295 is connected with the image forming apparatus 100 to transmit and receive various data between the image forming apparatus 100 and the book binding apparatus 200.

(The Outline of Control)

This control is to control a book binding apparatus so that whether the length of the front cover sheet and the back cover sheet of the cover sheet S2 is determined to be the length of the maximum book-body sheet S1max or to be the length of the minimum book-body sheet S1min, is arranged to be selectable, when conducting book binding by encasing the book-body including a plurality of book-body sheets having different lengths into a cover sheet. In general, since in almost all the cases, the length of the front cover sheet and the back cover sheet meets with the maximum book-body sheet length or the minimum book-body sheet length, in this control, the length of the front cover sheet and the back cover sheet is arranged to meet with either one of them.

Figure 3:
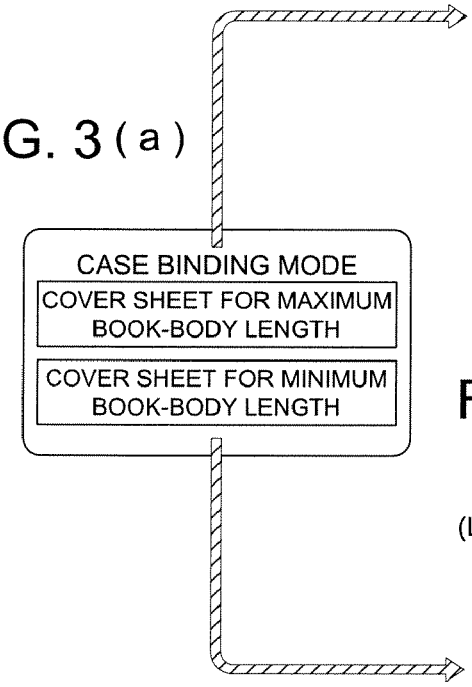
FIGS. 3(*a*)-(*c*)illustrate a schematic diagram of an outline of the control related to an embodiment of the present invention.
Figure 3:
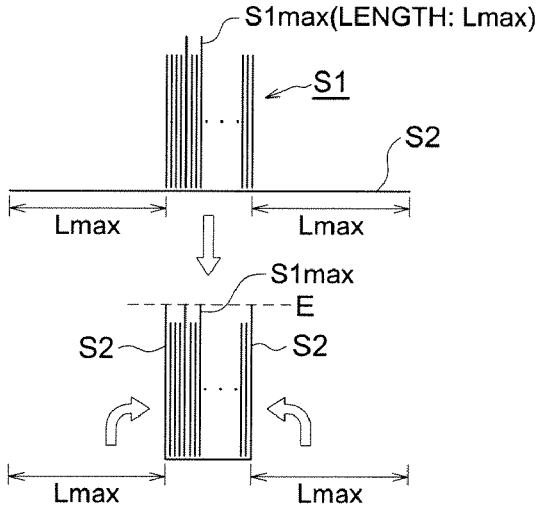
Figure 3:
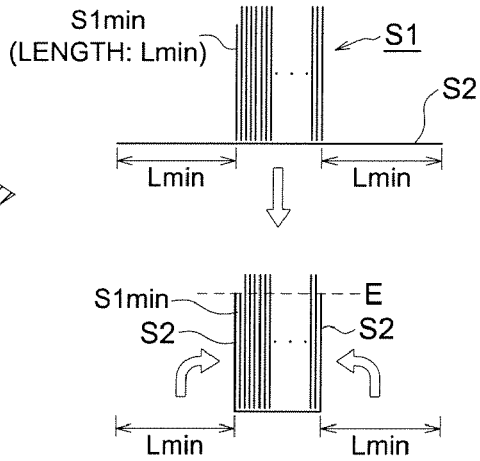

FIGS. 3(*a*)-(*c*) illustrate schematic diagrams showing an outline of the control related to an embodiment of the present invention. FIG. 3(*a*) illustrates an image drawing of the operation display section 166, which allows a user to be able to select whether "a cover sheet for maximum book-body length" or "a cover sheet for minimum book-body length". When "a cover sheet for maximum book-body length" is selected, the control for meeting the length of the front cover sheet and rear cover sheet of the cover sheet S2 with the length of the maximum book-body sheet S1max among the book-body sheets structuring the book-body is conducted (refer to FIG. 3(*b*)). When "a cover sheet for minimum book-body length" is selected, the control for meeting the length of the front cover sheet and the length of the rear cover sheet of the cover sheet S2 with the length of the minimum book-body sheet length S1min among the book-body sheets structuring the book-body is conducted (refer to FIG. 3(*c*)).

As shown in FIG. 3(*b*), when "a cover sheet for maximum book-body length" is selected, the cover sheet S2 is cut so that the front cover sheet and a rear cover sheet of the cover sheet S2 meets with the maximum book-body sheet length Lmax among the book-body sheets S1. After the cutting, when the cover sheet S2 encases the book-body, as shown in the figure, the edge position E of the cover sheet S2 and the edge position of the maximum book-body sheet S1max among the book-body sheets S1 coincide.

As shown in FIG. 3(*c*), when "a cover sheet for minimum book-body length" is selected, the cover sheet S2 is cut so that the front cover sheet and a rear cover sheet of the cover sheet S2 meets with the minimum book-body sheet length Lmin among the book-body sheets S1. After the cutting, when the cover sheet S2 encases the book-body, as shown in the figure, the edge position E of the cover sheet S2 and the edge position of the minimum book-body sheet S1min among the book-body sheets S1 coincide.

As described above, in the case when conducting case binding by encasing the book-body including different lengths of book-body sheets into a cover sheet, by conducting this control, since it becomes possible to select whether the length of the front cover sheet and the rear cover sheet of the cover sheet S2 is determined based on the length of the maximum book-body sheet S1max or the length of the front cover sheet and the rear cover sheet is determined based on length of the minimum book-body sheet S1min in book-body sheets, it becomes possible to conduct book binding in response to user needs.

(Control Flow)

Figure 4:
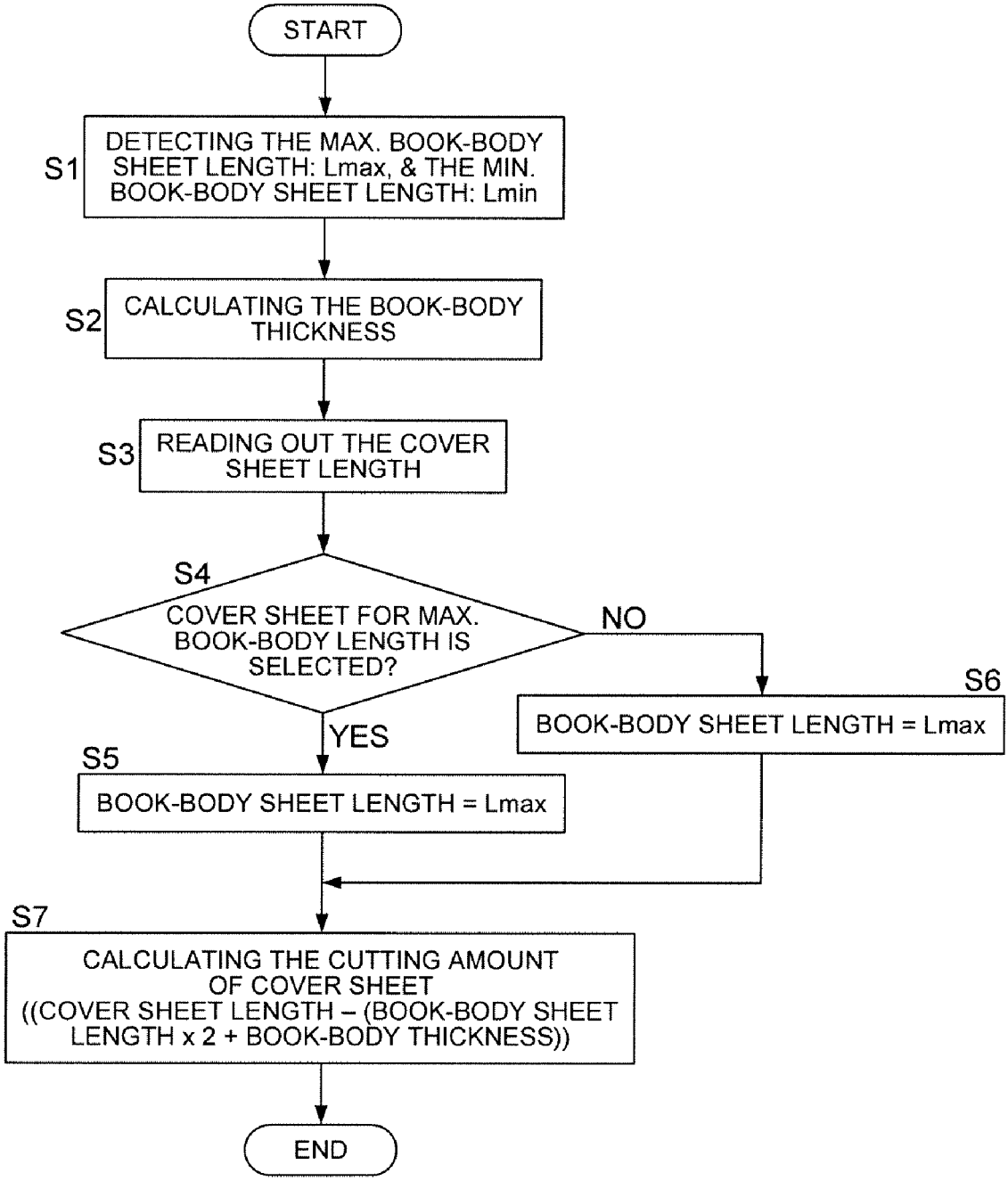
FIG. 4 illustrates a control flowchart of a cover sheet cutting amount calculation process related to an embodiment of the present invention.

FIG. 4 illustrates a control flowchart of a cover sheet cutting amount calculation process related to an embodiment of the present invention. This is an example of an embodiment but not limited to this example. The process for calculating the cutting amount of a cover sheet is executed based on a program stored in the ROM 292 centering on the CPU 290. It is assumed that the selection of whether "a cover sheet for maximum book-body length" or "a cover sheet for minimum book-body length", which has been described above, has been completed by the operation display section 166 of the image forming apparatus 100 and the selection information has been memorized in RAM 163. The operation display section 166 functions as a selection section. It is also assumed that the length of cover sheet S2 stored in the sheet feed cassette 143 or the sheet feeding cassette 271 has been inputted through the operation display section 166 and stored on the EEPROM 165 in advance.

Firstly, the CPU 290 measures the length of respective book-body sheets S1 conveyed from the image information forming apparatus 100 by using the sheet length sensor 294. The CPU 290 detects the length Lmax of the maximum book-body sheet Smax and the length Lmin of the minimum book-body sheet Smin. The CPU 290 and the sheet length sensor 294 function as a first detection section for detecting the length of the book-body sheet. The RAM 290 memorizes the detected Lmax and Lmin (step S1).

Concretely, the lengths L of respective book-body sheets S1 can be obtained by multiplying the time period T, within which the sheet length sensor 294 is kept in an on state by the passage of the respective book-body sheets S1, to a conveyance-velocity V of the sheet in the sheet length sensor section 294 ($L=V\times T$).

When detecting the Lmax and the Lmin, before detecting the first book-body sheets S1 of the booklet, the Lmax value and the Lmin value in the RAM 293 should be reset, then the lengths L of the respective book-body sheets S1 should be sequentially measured from the first to the end of the booklet. In this situation, every time when the maximum length or the minimum length is obtained, the Lmax value or the Lmin value in the RAM 293 is updated.

Next, the CPU 290 detects the position of the clamp 244 by using the thickness sensor 245 (step S2). The CPU 290 and the thickness sensor 245 function as a second detection section for detecting the thickness of the book-body sheet.

Next, the CPU 290 reads out the cover sheet length S2 (step S3). The CPU 290 and the EEPROM 165 function as a third detection section for detecting the cover sheet length.

Next, the CPU 290 checks the selection information stored in the RAM 163 to determine whether "a cover sheet for maximum book-body length" has been selected (step S4).

When having been determined that "a cover sheet for maximum book-body length" has been selected (step S4; YES), the CPU 290 reads out the Lmax stored in the RAM 293, and set as the book-body sheet length (step S5). When having been determined that "a cover sheet for maximum book-body length" has not been selected (step S4; NO), namely, the CPU 290 has determined that that "a cover sheet for minumum book-body length" has been selected, the CPU 290 reads out the Lmin stored in the RAM 293, and set as the book-body sheet length (step S6).

Next, the CPU 290 calculates the cutting amount of the cover sheet S2. The cutting amount of the cover sheet S2 is calculated by a formula (cover sheet length−(book-body sheet length×2+book-body thickness)) (step S7). The CPU 290 functions as a calculation section for calculating a cutting amount of a cover sheet. The cover sheet S2 is cut based on this cutting amount at the trimming section 275.

As described above, the cover sheet S2 length after cutting can be controlled based on the fact that the value of "a book-body sheet length" used when calculating the cutting amount of the cover sheet in the step 7 changes in response to the selection whether "a cover sheet for maximum book-body length" or "a cover sheet for minimum book-body length".

Figure 5:
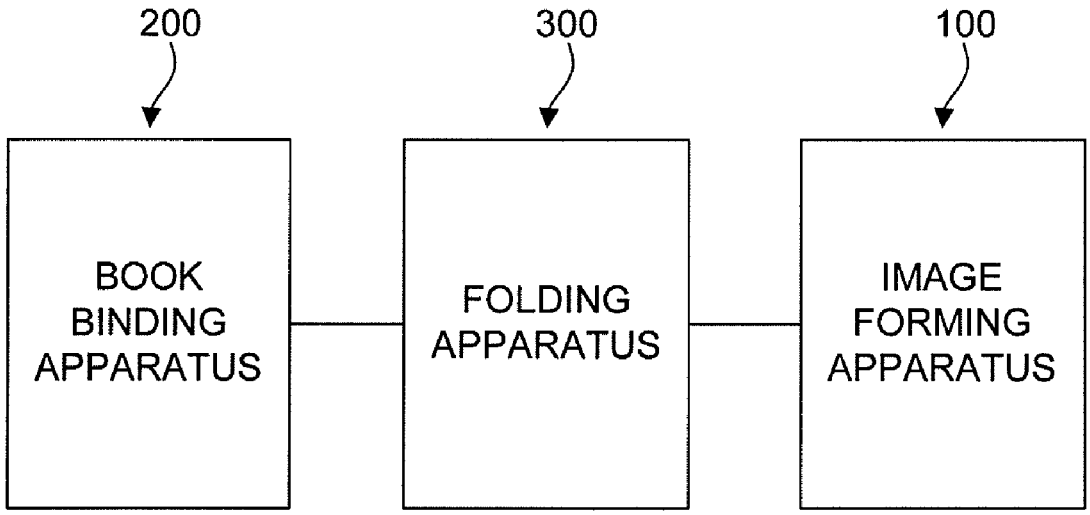
FIG. 5 illustrates an exemplary system having a book binding apparatus, folding apparatus, and image forming apparatus.

In this embodiment, the sheet length sensor 294 is arranged to measure the length of the book-body sheets S1. However, the EEPROM 165 may memorized the length of the book-body sheets S1 by correlating the sheet length to the sheet feeding cassettes 141 and 142 for storing the book-body sheets S1. However, when providing a folding apparatus 300 between the image forming apparatus 100 and the book binding apparatus 200 (as shown in FIG. 5), and using the folding sheets as the book-body sheets S1, the method of measuring the length of the book-body sheets S1 by using a sheet length sensor 294 is employed.

The reason is that when including the folded sheets as the book-body sheets S1, for example, when a A4 or a A3 size sheet, which has been folded in a "Z" shape (after having folded in a "Z" shape, it is a A4 size sheet) is used as a book-body sheet S1, if the length of the book-body sheet S1 correlated to the sheet feeding cassette memorized in the EEPROM 165 is used and if "a cover sheet for maximum book-body length" has been selected, the length of A3 is supposed to be detected as the maximum length of a book-body sheet. Thus the length of the front cover sheet and the rear cover sheet of the cover sheet S2 becomes the length of A3 sheet and the booklet, which a user does not intend to make, is formed.

In this embodiment, the selection of "a cover sheet for maximum book-body length" or "a cover sheet for minimum book-body length" is conducted on the operation display section 166 of the image forming apparatus 100. However, when a personal computer inputs image data through the communication section 168, the selection may be conducted on a printer driver screen of the personal computer.

According to the present invention, when conducting a case binding by encasing a book-body including book-body sheets having different lengths into a cover sheet, since the selection whether the length the front cover sheet and rear cover sheet of a cover sheet S2 is met with the maximum book-body sheet length or the minimum book-body sheet length is available, the book binding can be conducted under the book biding aspect, which meets the user needs.

What is claimed is:

1. An image forming system including an image forming apparatus which forms an image on a book-body sheet and a book binding apparatus which conducts book binding by encasing a bundle of book-body sheets with a U-shaped cover sheet, the image forming system comprising:

a first detection section which detects a maximum book-body sheet length and a minimum book-body sheet length among length of sheets in the bundle of the book-body sheets;

a second detection section which detects a thickness of the bundle of the book-body sheets;

a third detection section which detects a cover sheet length;

a selection section to select whether the cover sheet length is determined based on the maximum book-body sheet length or on the minimum book-body sheet length;

a calculation section which calculates a cutting amount of the cover sheet based on the maximum book-body sheet length detected by the first detection section, the thickness of the bundle of the book-body sheets detected by the second detection section and the cover sheet length detected by the third detection section when selected is that the cover sheet length is determined based on the maximum book-body sheet length by the selection section, and which calculates a cutting amount of the cover sheet based on the minimum book-body sheet length detected by the first detection section, the thickness of the bundle of the book-body sheets detected by the second detection section and the cover sheet length detected by the third detection section when selected is that the cover sheet length is determined based on the minimum book-body sheet length by the selection section;

a trimming section which cuts the cover sheet based on the cutting amount of the cover sheet calculated by the calculation section; and a book binding section which conducts a book binding by encasing the bundle of sheets of the book-body with the U-shaped cover sheet.

2. The image forming system of claim 1, wherein the first detection section detects the maximum book-body sheet length and the minimum book-body sheet length among length of sheets in the bundle of the book-body sheets, based on outputs of a sheet sensor provided on a conveyance path of the book binding apparatus through which the book-body sheet passes.

3. The image forming system of claim 2, further comprising a folding apparatus which conducts a folding process of the book-body sheet on which an image has been formed by the image forming apparatus, and which supplies the folded book-body sheet to the book binding apparatus.

4. The image forming system of claim 1, further comprising:

a sheet feeding section which stores the cover sheet; and a memory section which previously memorizes length of the cover sheet to be stored in the cover sheet feeding section, wherein, the third detecting section detects the length of the cover sheet, based on the length of the cover sheet memorized in the memory section.

5. The image forming system of claim 4, further comprising a sheet feeding section which stores the book-body sheet, wherein the memory section further memorizes length of the book-body sheet to be stored in the sheet feeding section, wherein, the first detecting section detects the maximum book-body sheet length and the minimum book-body sheet length among length of sheets in the bundle of the book-body sheets, based on the length of the book-body sheet memorized in the memory section.

* * * * *